US011766078B2

(12) United States Patent
Walker

(10) Patent No.: US 11,766,078 B2
(45) Date of Patent: Sep. 26, 2023

(54) LOWER LEG SLEEVE

(71) Applicant: Bruce Walker, Baton Rouge, LA (US)

(72) Inventor: Bruce Walker, Baton Rouge, LA (US)

( * ) Notice: Subject to any disclaimer, the term of this patent is extended or adjusted under 35 U.S.C. 154(b) by 901 days.

(21) Appl. No.: 16/715,161

(22) Filed: Dec. 16, 2019

(65) Prior Publication Data

US 2021/0177073 A1 Jun. 17, 2021

(51) Int. Cl.
*A41D 13/005* (2006.01)
*A41D 27/10* (2006.01)

(52) U.S. Cl.
CPC ..... *A41D 13/0053* (2013.01); *A41D 27/10* (2013.01)

(58) Field of Classification Search
CPC ..... A41D 13/0053; A41D 27/10
See application file for complete search history.

(56) References Cited

U.S. PATENT DOCUMENTS 2,125,451 A * 8/1938 Kolliner ..... A41D 17/00 2/242
5,566,396 A * 10/1996 Leib ..... D04B 1/26 2/239
5,729,836 A * 3/1998 Ewing ..... A41B 11/003 2/409
6,199,217 B1 * 3/2001 Mooney ..... A41D 17/00 2/240
6,276,176 B1 * 8/2001 Blakely ..... A41B 11/14 66/178 R
7,192,411 B2 * 3/2007 Gobet ..... A61F 13/08 66/183
D640,420 S * 6/2011 Miller ..... D29/120.1
D649,772 S * 12/2011 Stewart ..... D2/980
D650,166 S * 12/2011 Stewart ..... D2/980

* cited by examiner

*Primary Examiner* — Gloria M Hale

(74) *Attorney, Agent, or Firm* — Ronald D. Baker; BAKER & CO., PATENT LAW

(57) ABSTRACT

The present invention is an improved leg sleeve that is designed by utilizing wicking fabric for cooling and protecting a user's legs from UV rays. In particular, the invention allows a user to participate in physical activities such as sports and keep moisture and direct sun rays away from the skin, thus keeping extremities cool. The proposed embodiment provides a unique experience for those individuals who wish to protect their bodies from dangerous heat while remaining active.

3 Claims, 3 Drawing Sheets

LOWER LEG SLEEVE

CROSS-REFERENCE TO RELATED APPLICATIONS

None.

COPYRIGHT AND TRADEMARK NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever. Trademarks are the property of their respective owners.

BACKGROUND OF THE INVENTION

Field of the Art

The disclosure relates to a leg sleeve that provides a method to keep the user's extremities cool while participating in physical activity. The embodiment is also designed to block sun rays.

Discussion of the State of the Art

Participating in activities such as sports can generate a lot of heat which is uncomfortable for people. Often such heat can cause a person's performance to be affected as a result. Traditionally a person can encounter health issues such as muscle cramps, dehydration, and even make it harder for the brain to get enough blood thus causing dizziness. Sports Is a major attraction for the general public not to mention the amount of revenue that sports such as golf and football generate every year. Where professional athletes are involved in such sports it can be critical that they are performing at their absolute best. In general, those who are tasked with insuring that athletes are performing at their peak has been challenged with providing a solution for managing heat while participating in physical activities such as sports and the like.

To elaborate, athletes such as golfers often perform under extreme heat in locations such as Florida and often, they endure direct rays which can be dangerous. Protecting their skin as well as wearing clothing that minimizes direct sun rays can mean a lot to an athlete and can increase his performance. Currently, athletes are often injured as a result of direct heat especially when they are not properly hydrating. Recent studies have showed that individuals who are exposed to extreme heats without adequate protection is at a much higher risk of being injured than those who do take steps to protect their exposure.

Accordingly, what is needed in the art is an article of active wear that can be worn along the lower leg for protecting a person from direct sun rays. What is further needed in the art is an article of active wear for the lower legs that will cool the skin while dispelling heat. The proposed embodiment is further ideal because its ultimate purpose is to protect against heat while providing a cooling effect on the surface of the skin will be a welcoming change for active individuals.

SUMMARY OF THE INVENTION

Accordingly, the inventor has conceived, in a preferred embodiment of the invention, an article of active wear for the lower legs that will keep a user's skin dry and cool while protecting against heat. According to a preferred embodiment of the invention, an article of active wear that is preferably worn on a user's lower legs for providing a novel way of dispensing heat and allowing the skin to remain cool and dry. The proposed embodiment comprises a variety of wicking fabrics organized in a specific manner. The embodiment includes various material manufactured in a frustoconical shaped article that is pulled over the lower leg. The wicking material strike sweat from the surface of the body by utilizing a ratio of material that help to prevent ultraviolet rays from the skin and allows the fabric to breath thus cooling a user's legs. Further according to the embodiment, the sleeve will be strategically positioned just above the user's ankles and extend above the calves just short of the knee. The frame design along with the sleek body of the embodiment can be easily placed and removed from the user's leg by pulling. In an ideal embodiment, the sleeve will maintain a shape and size that will hug the contours of a user's legs. This design will allow the sleeve to protect all skin surfaces that come in contact with the embodiment.

BRIEF DESCRIPTION OF THE DRAWING FIGURES

The accompanying drawings illustrate several embodiments of the invention and, together with the description, serve to explain the principles of the invention according to the embodiments. It will be appreciated by one skilled in the art that the particular embodiments illustrated in the drawings are merely exemplary and are not to be considered as limiting of the scope of the invention or the claims herein in any way, FIG. 1 is a perspective view of the lower leg sleeve for cooling skin, according to a preferred embodiment of the invention;

DETAILED DESCRIPTION

Figure 1:
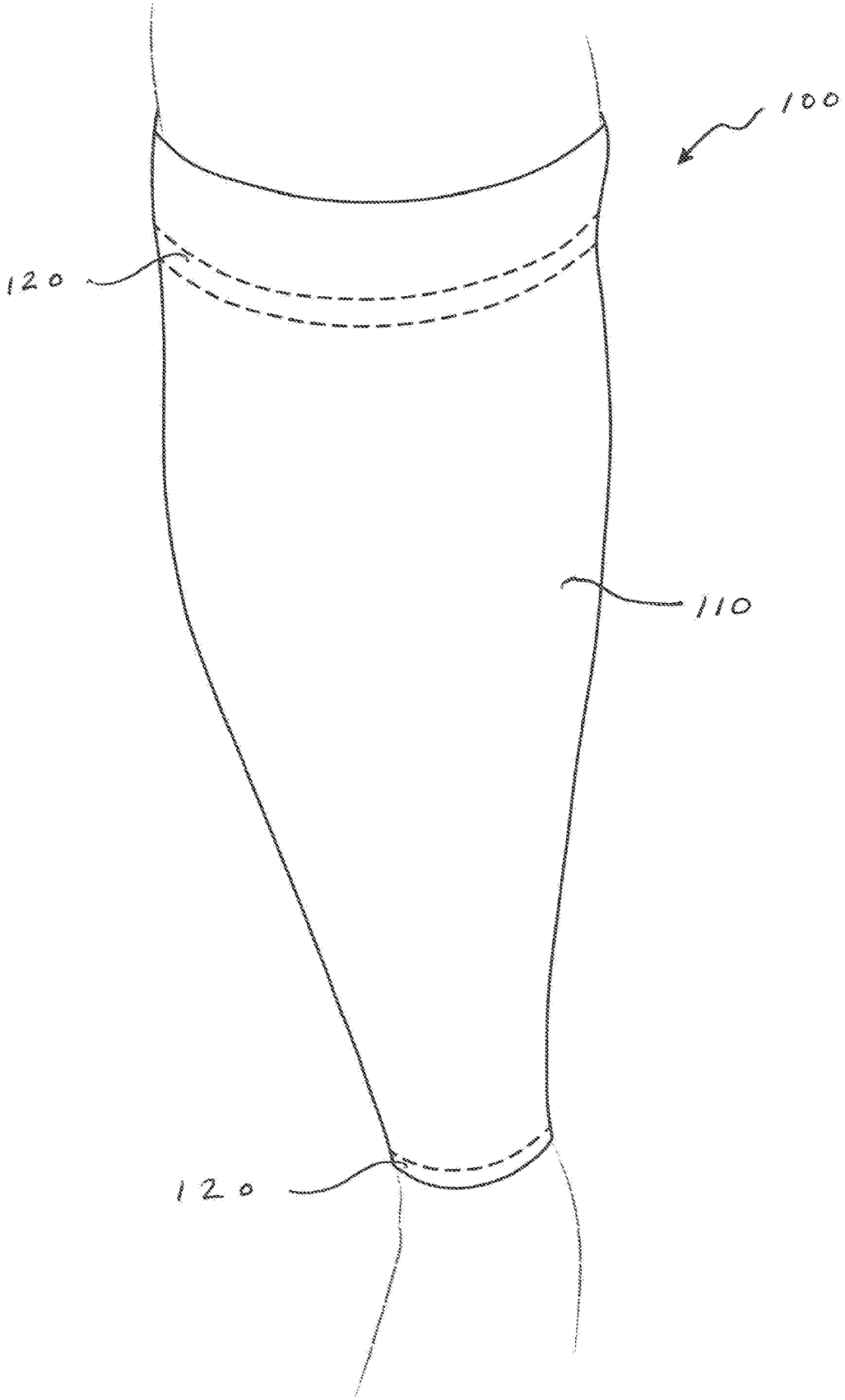

The inventor has conceived, a lower leg sleeve for cooling and protecting a user's skin during sports and other related activities. The embodiment helps to cool down the body during physical activity by utilizing wicking material along a user's legs in a way that has never been utilized before.

One or more different inventions may be described in the present application. Further, for one or more of the inventions described herein, numerous alternative embodiments may be described; it should be appreciated that these are presented for illustrative purposes only and are not limiting of the inventions contained herein or the claims presented herein in any way. One or more of the inventions may be widely applicable to numerous embodiments, as may be readily apparent from the disclosure. In general, embodiments are described in sufficient detail to enable those skilled in the art to practice one or more of the inventions, and it should be appreciated that other embodiments may be utilized and that structural changes may be made without departing from the scope of the particular inventions. Accordingly, one skilled in the art will recognize that one or more of the inventions may be practiced with various modifications and alterations. Particular features of one or more of the inventions described herein may be described with reference to one or more particular embodiments or figures that form a part of the present disclosure, and in which are shown, by way of illustration, specific embodiments of one or more of the inventions. It should be appreciated, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only and are not to be taken as limiting the disclosure in any way.

A description of an embodiment with several components in connection with each other does not imply that all such components are required. To the contrary, a variety of optional components may be described to illustrate a wide variety of possible embodiments of one or more of the inventions and in order to more fully illustrate one or more aspects of the inventions.

Material described or referenced herein will sometimes be described in singular form for clarity. However, it should be appreciated that particular embodiments may include multiple instantiations of a material unless noted otherwise. Blocks in figures should may, in some embodiments be understood as representing segments or portions of those embodiments. Alternate implementations are included within the scope of embodiments of the present invention would be understood by those having ordinary skill in the art.

Definitions

The terms "a" or "an", as used herein, are defined as one, or more than one. The term "plurality", as used herein, is defined as two, or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an exemplary embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

Wicking material is a kind of fabric that is commonly used in workout clothing that is designed to pull moisture away from the skin. The fabric draws sweat and perspiration off of the skin and out to the exterior of the fabric.

Exemplary Embodiments

The improved lower leg sleeve is a novel invention that is aimed at keeping the lower legs cool and dry by utilizing wicking material. The sleeve is applied to the lower portion of the leg to help keep sweat away from the user's skin. Wicking material is key to this invention in that it is critical at keeping a person's body cool about the legs in a way that has not been utilized. The key concept of this invention is that most athletes focus on trying to cool their upper torso but fail to focus on cooling their legs. In an exemplary embodiment, the lower leg sleeve will help cool and protect from heat at the same time thus preventing such ailments as cramps. The lower leg sleeve is specially designed to hug the contours of a person's legs in way that covers the critical portions of the leg that will mostly benefit a user. Expansion bands are utilized to ensure the sleeve fits the contours of the legs and provides support to prevent the sleeve from sliding or rolling at either end of the sleeve. At least two expansion bands will be used along the sleeve; ideally one expansion band per sleeve will be positioned just above the calve and a second band per sleeve will be positioned just above the ankle. Elastic stitches will be designed along the rear of each sleeve in a vertical fashion extending from the top end to the bottom end of each sleeve. The elastic stitching provides a level of adjustability for various sized legs and works to support the contours of a person's leg. Using wicking material in this manner can help an athlete's performance during tough events such as where the user is participating in a tournament for example. To elaborate, the wicking material will dispel heat and keep moisture from the user's skin which will not only provide comfort but also provide some physical benefits that can prevent injury. When heat is retained in the body a person can encounter heat exhaustion which occurs when the body can't get cool enough and sweats away too much water and salt. The body begins to get pale and clammy, and body temperature can get over 100 degrees. A person can start to feel tired, weak, experience headaches, feel lightheaded, nauseated, and even have heat strokes as a result. It is a proven fact that athletes radiate heat around their lower legs and feet and applying a wicker material to the lower leg area can help an athlete stay cool longer and optimize athletic performance.

FIG. 1 is a perspective view of a lower leg sleeve 100 for cooling and protecting a user's skin during sports and other related activities according to a preferred embodiment of the invention. According to the embodiment a lower leg sleeve comprises a sleek body 110 with expansion bands 120 positioned just below the knee and just above the user's ankle. In a non-limiting example, the body 110 of the sleeve may come in various colors and include designs depending on the user's preference. The perspective view shows a depiction of the lower leg sleeve being worn along a user's leg in a preferred manner.

Figure 2:
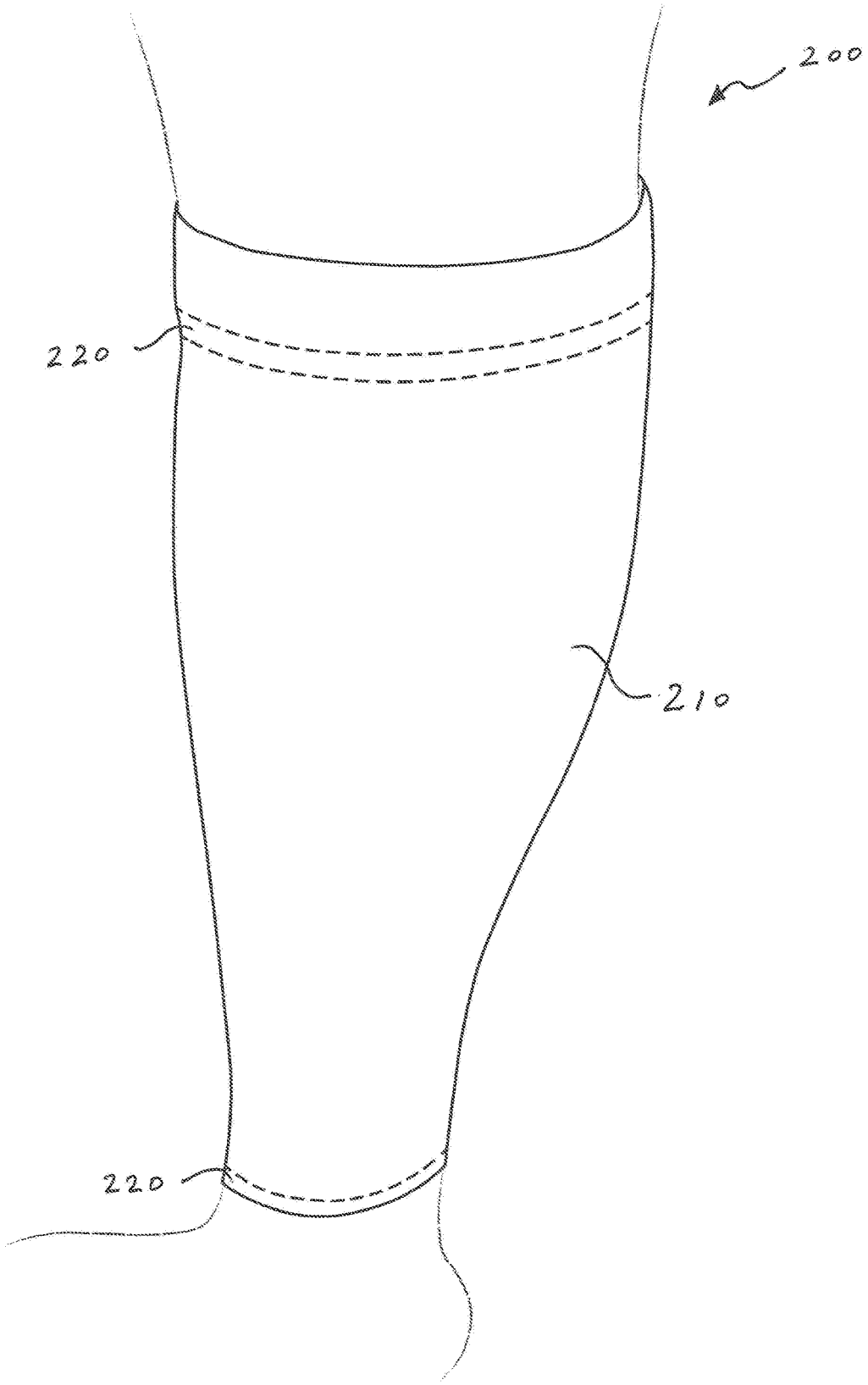
FIG. 2 is a side-view illustrating the lower leg sleeve for cooling skin, according to a preferred embodiment of the invention.

FIG. 2 is a side-view illustrating a lower leg sleeve 200 for cooling and protecting a user's skin during sports and other related activities according to a preferred embodiment of the invention. According to the embodiment a lower sleeve comprises a sleek body 210 with elastics bands 220 positioned just below the knee and just above the user's ankle. As depicted, the lower sleeve fits sleekly along the user's calve in a manner that allows for a snug fit against the user's skin surface to assist with cooling.

Figure 3:
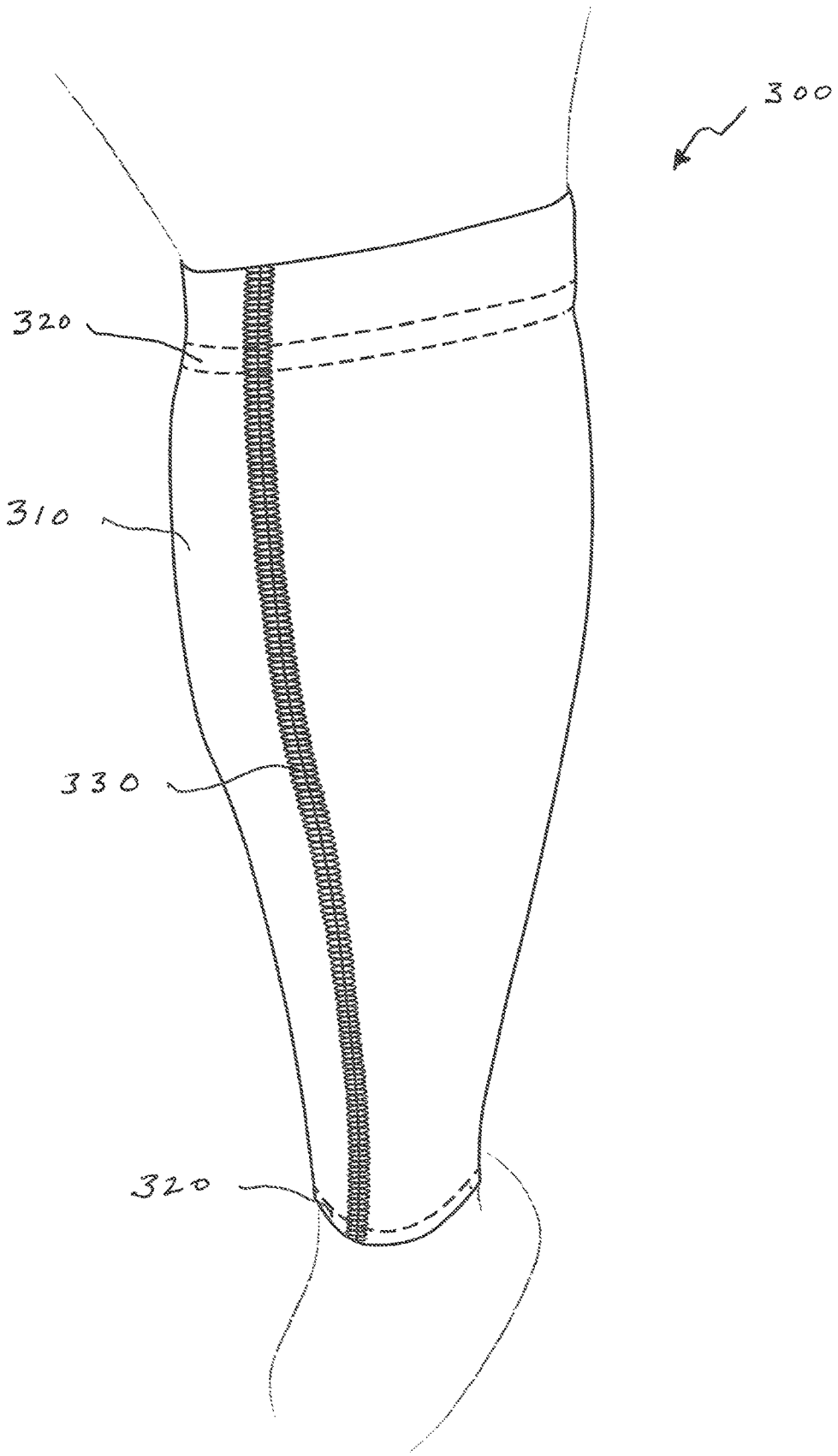
FIG. 3 is a rear-view illustrating the lower leg sleeve for cooling skin, according to a preferred embodiment of the invention.

FIG. 3 is a rear view illustrating a lower leg sleeve 300 for cooling and protecting a user's skin during sports and other related activities according to a preferred embodiment of the invention. According to the embodiment a lower sleeve comprises a sleek body 310 with elastics bands 320 positioned just below the knee and just above the user's ankle. The illustration accordingly shows elastic stitching 330 in the rear portion of the sleeve along the vertical length of the leg sleeve.

The skilled person will be aware of a range of possible modifications of the various embodiments described above. Accordingly, the present invention is defined by the claims and their equivalents.

What is claimed is:

1. A sleeve shaped and sized to cover lower leg extremities for cooling skin of a user, the sleeve comprising:

an upper opening on an upper end and a lower opening on a lower end allowing a user to slip on to a leg; constructed of materials that confirm to body contours forming a tight fit covering a lower portion of the leg; and having integral covering sections with integrated expansion bands along various portions of the sleeve to grip said lower portion of the leg preventing said sleeve from creeping, rolling, or becoming otherwise loose, wherein a rear portion of said sleeve includes elastic stitching that extends vertically from the upper and lower ends of said sleeve; wherein said sleeve includes material made from various layers of wicking material in a manner to cool said user's skin.

2. The sleeve as claimed in claim 1, wherein a center portion between the upper and lower openings is of a greater diameter so that it is spaced from the skin of the user when it is applied to the lower portion of the leg.

3. The sleeve as claimed in claim 1, wherein the sleeve is of frusto-conical shape and is particularly adapted for use on the lower portion of the leg of said user or a large end of the sleeve overlies a calve muscle of said user and a small end of the sleeve engages the leg just above an ankle of said user.

* * * * *